US005230162A

United States Patent [19]

Oyler, Jr.

[11] Patent Number: 5,230,162

[45] Date of Patent: Jul. 27, 1993

[54] SYSTEMS AND METHODS FOR THE DELIQUIFICATION OF LIQUID-CONTAINING SUBSTANCES BY FLASH SUBLIMATION

[76] Inventor: James R. Oyler, Jr., 2801 Ocean Dr., Vero Beach, Fla. 32963

[21] Appl. No.: 904,661

[22] Filed: Jun. 26, 1992

[51] Int. Cl.[5] ..... F26B 13/30

[52] U.S. Cl. ..... 34/5; 34/92

[58] Field of Search ..... 34/5, 15, 92, 17

[56] References Cited

U.S. PATENT DOCUMENTS 4,590,684 5/1986 Arsem ..... 34/5

4,608,764 9/1986 Leuenberger ..... 34/5

*Primary Examiner*—Henry A. Bennet

*Attorney, Agent, or Firm*—Carroll F. Palmer

[57] ABSTRACT

In a freeze-drying method, liquid substances to be dried are sprayed into a stream of cold gas, usually air, at ambient pressure creating a collection of small frozen particles that are metered through a vacuum lock into a vacuumized vertical tower having heated walls and, as the particles fall through the vacuum in the tower to its bottom, radiant heat from the tower walls causes the ice contained in the particles to sublime. The resulting sublimed vapor is removed from the tower by low temperature condensation while the dried particles are collected at the bottom and transferred through another vacuum lock into a container. The operation is continuous and fast, providing significant advantages compared to prior known freeze-drying operations.

21 Claims, 6 Drawing Sheets

SYSTEMS AND METHODS FOR THE DELIQUIFICATION OF LIQUID-CONTAINING SUBSTANCES BY FLASH SUBLIMATION

BACKGROUND OF THE INVENTION

1. Field of the Invention

This application relates to improved systems and methods for the deliquification of liquid-containing substances by freeze-drying, particularly, dehydration of water-containing substances. By these systems and methods, a wide variety of substances can be deliquified, e.g., dried, more rapidly and economically than previously possible.

2. Description of the Prior Art

Freeze-drying is a method of dehydration of water-containing materials which yields a high quality, water free product. The high quality results from the nature of the process, which by definition involves the removal of water while the product is frozen. By remaining frozen during the dehydration, the product is largely protected from deleterious effects of heat, from the loss of volatile essences, and from adverse oxidation effects.

Removal of the water takes place by sublimation, i.e., vaporization of the solid without going through the liquid state, e.g., see U.S. Pat. No. 4,608,764. (Reference is made to water, but the liquid removed could be any that is capable of sublimation under the conditions involved.)

In conventional freeze-drying practice, the material is kept below freezing at very low pressure (essentially a vacuum) while providing the heat of vaporization and removing the vapor, e.g., see U.S. Pat. Nos. 2,471,035; 3,300,868; 3,362,835; 3,396,475; 3,909,957 and 4,016,657. Some systems have also been developed which operate at atmospheric total pressure, but very low partial pressures for the sublimation vapor, e.g., U.S. Pat. No. 3,313,032.

A key factor in such prior known systems is the relative slowness of drying. The simplest method used in practice is to freeze the material to be dried on trays, which are then loaded into a chamber equipped for the necessary vacuum, heating, and vapor removal. The vapor must penetrate through a relatively thick layer of frozen material, leading to typical drying cycles of 24 to 48 hours. Even in systems which work with thin layers or small particles, the usual cycles are still in the order of minutes to hours. Most such dryers operate in batch cycles since continuous freeze-dryers are typically much more complex and expensive. The equipment needed to achieve volume production generally becomes large and expensive.

In summation, existing freeze-drying processes and methods are slow, expensive, or both, resulting in their limited economic applicability despite well-known potential advantages of the freeze-drying concept. The present invention addresses these deficiencies of the prior art and provides improved systems and methods for the deliquification of liquid-containing substances by freeze-drying, particularly, dehydration of water-containing substances, that mitigate such prior art deficiencies.

While the terms "dehydration" and "drying", as used in this specification and the accompanying claims, concern principally the removal of water from aqueous materials, they are intended to encompass the deliquification of materials which contain liquids other than water, alone or in combination with water, e.g., organic solvents like alcohol, etc.

OBJECTS OF THE INVENTION

A principal object of the present invention is the provision of improved systems and methods for the deliquification of liquid-containing substances, particularly, for freeze-drying of water-containing substances.

Further objects include the provision of new freeze-drying systems and methods that:

1. Involve much faster drying cycles than prior known freeze-drying systems and methods.
2. Operate continuously.
3. Require minimal investment in equipment.
4. Achieve high volume production with limited space and equipment.
5. Produce a fine, uniform product with no additional processing or handling.

SUMMARY OF THE INVENTION

The objects are accomplished by unique freeze-drying methods that spray the liquid to be processed into a stream of very cold gas, forming small frozen droplets or particles. This operation takes place in a freezing vessel which contains the cold gas and the particles. The particles settle to the bottom of the vessel, where they are metered by a rotary valve into a vertical drying tower separate from the freezing vessel. The drying tower is associated with vacuum means, ice condensers, and a heat source.

The space inside the tower is evacuated to a vacuum through which the particles fall. The drying tower is equipped with a heat source, which provides the heat of sublimation to dry the particles. The temperature and length of such heating zone are set to achieve the desired dryness in the exact flight time of the particles through the zone. The particles fall to the bottom of the tower where they can be removed.

The vapor formed by sublimation is removed by vapor condensers communicating with the tower. The condensers are at a temperature low enough to ensure that the vapor will be removed while preventing the particles from melting.

In practice, the size of the particles establishes many of the operating parameters of the system. For the typical system in accordance with the invention, the particles are approximately 100 microns in diameter. (The size of the particles as well as other dimensions and data are provided for illustration, not as limitations on the invention.) With particles of this size, the water contained in them freezes almost instantaneously when contacted by the cold gas in the freezer vessel. The ice crystals that form are of the same order of size as the liquid particle itself, so the crystals are fully exposed on the surface. The vapor formed by sublimation disperses instantly from the particle, involving no transport or diffusion from the interior of the particle. These factors account for the very short drying times.

As mentioned, the particles are frozen by spraying the liquid into a very cold gas in the freezer vessel. This spraying step, as well as the design of the nozzle, must be capable of forming particles of the desired size with various feed materials and flow rates. The nozzle is surrounded by a plenum which routes the cold gas around the nozzle in intimate contact with the spray of liquid particles. Exit ports are provided in positions which exhaust the gas while allowing the particles to settle out of the gas stream into the bottom of the freezer vessel and thence to the rotary valve to be fed into the tower. The gas is recirculated through a heat exchanger to cool it for another circuit through the freezer vessel. The heat exchanger and associated refrigeration must be capable of lowering the particle temperature below the lowest freezing point of the sprayed liquids; in practice, the freeze-gas may be as cold as −60° C. (In general the gas can be air, but for some materials it may be desirable to use an inert gas such as nitrogen.)

Once inside the drying tower, the particles are exposed to heat radiating from its sides. For a typical system, the drying zone is at least 3 meters long in a tower of at least about 1 meter diameter, and will generally be at a temperature over 200° C. (The temperature is determined primarily by the Stefan-Boltzmann law, the dimensions of the particle and tower and the production rate.) The flight time through this zone is under about 1 second; in this time the ice is flash-sublimed while the particles fall clear of the hot section. The energy absorbed by the particles is equal to the heat of sublimation, so the temperature of the residual solids does not increase.

The vapor condensers are at a temperature lower than the highest temperature the particle can be allowed to reach. Some substances will remain frozen almost to the melting point of water (0° C.), while others will begin to soften or get sticky at temperatures as low as −40° C. The vapor condenses and associated refrigeration must be capable of remaining below the lowest of these temperatures.

Since the vapor condenser is always colder than the vapor, the pressure differential thus established will move the vapor toward the condenser, where it will be removed by refreezing. Advantageously, the system is provided with at least two condensers, so that as one becomes loaded it can be toggled off and defrosted while another continues in operation for continuous processing.

The bottom of the tower is equipped with a vacuum lock so that product can be removed without breaking the vacuum.

The total time from spraying the liquid to settling of the dried particles at the bottom of the tower is only a few seconds. All equipment can be continuously operated at full capacity, resulting in the highest possible efficiency, utilization, and throughput.

One side effect of the design is that fine particles of dried material will be in the vicinity of high temperatures, which could result in ignition and explosion of any material in the tower. In a vacuum, however, combustion cannot occur, so interlocks are provided to stop the system if the vacuum is ever broken during processing. As a further precaution, the tower is equipped with an over-pressure release.

The products produced according to the invention are fine powders of uniform size, dehydrated, still cold, and under a vacuum. The vacuum can be maintained during subsequent packaging, thus preventing any possible entry of moisture or oxygen which could degrade the contents over time. Eventually, the product will reach room temperature, where it can be held for long periods as long as the package is intact. Since no further processing or handling is needed (grinding, milling, classifying, etc.), possible exposure to adverse conditions is effectively eliminated, resulting in both low cost production and high quality of product.

The improvements achieved by the invention provide advantages in the deliquification of a wide variety of liquid substances, including foods, biological materials, flavorings and fragrances, certain chemicals, organic and inorganic catalysts, and others.

DETAILED DESCRIPTION OF THE DRAWINGS

In the following discussion, specific dimensions or temperatures may be given for illustration purposes. Unless otherwise noted, such numbers are for illustration and other values are possible as alternate embodiments of the invention.

Figure 1:
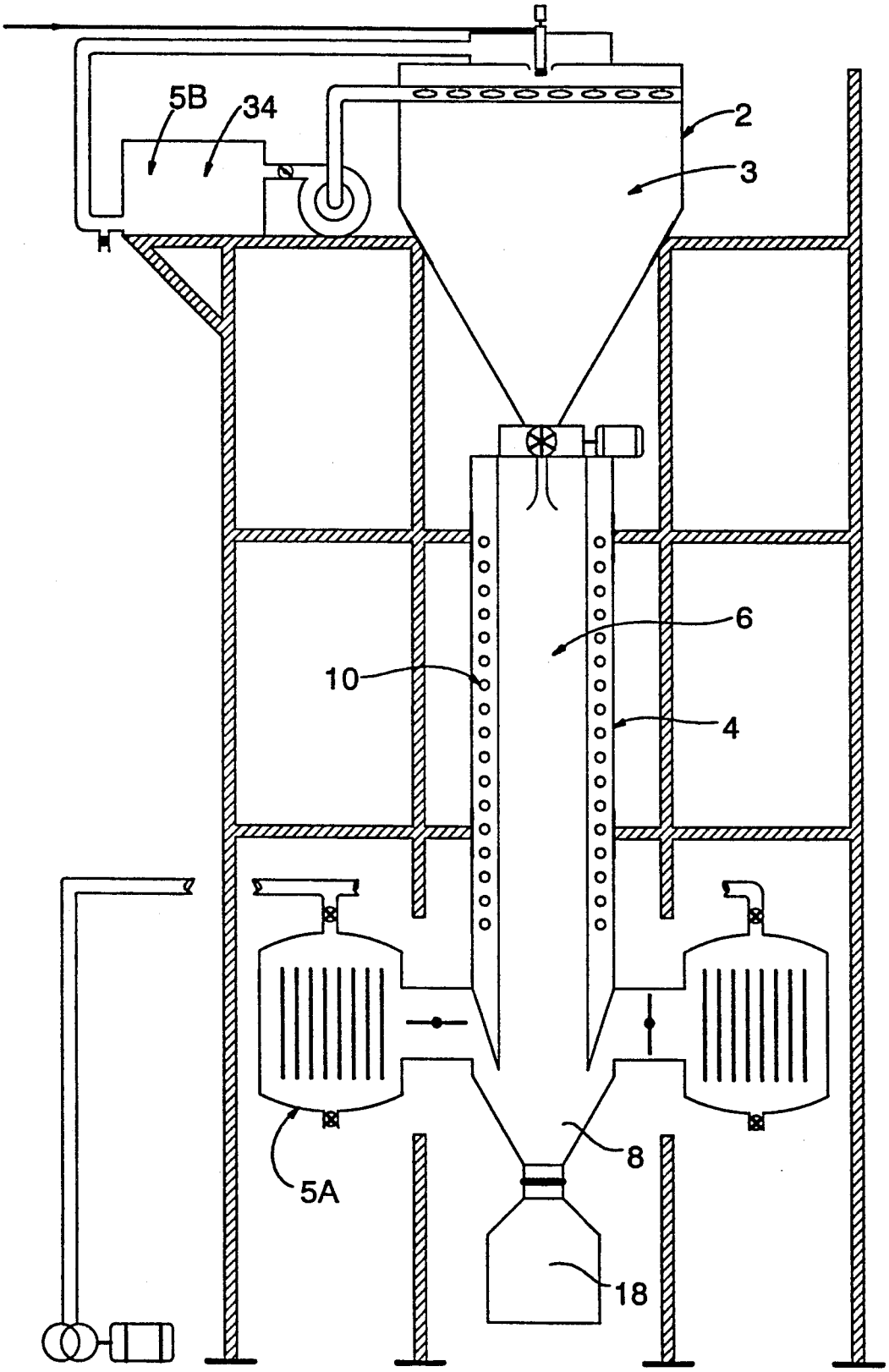
FIG. 1 is a diagrammatic elevational view of a first embodiment of a freeze drying system in accordance with the invention, including a supporting structure.

The overall elevation shown in FIG. 1 is a lateral scaled view of the system 2, the overall height of which from the bottom of the supporting structure to its topmost element is approximately 10 meters. This view shows only those elements described below in detail. Other components, such as refrigeration machinery, product storage tanks, packaging machinery, etc. are not shown since they are conventional in nature and do not form a part of the invention.

Figure 2:
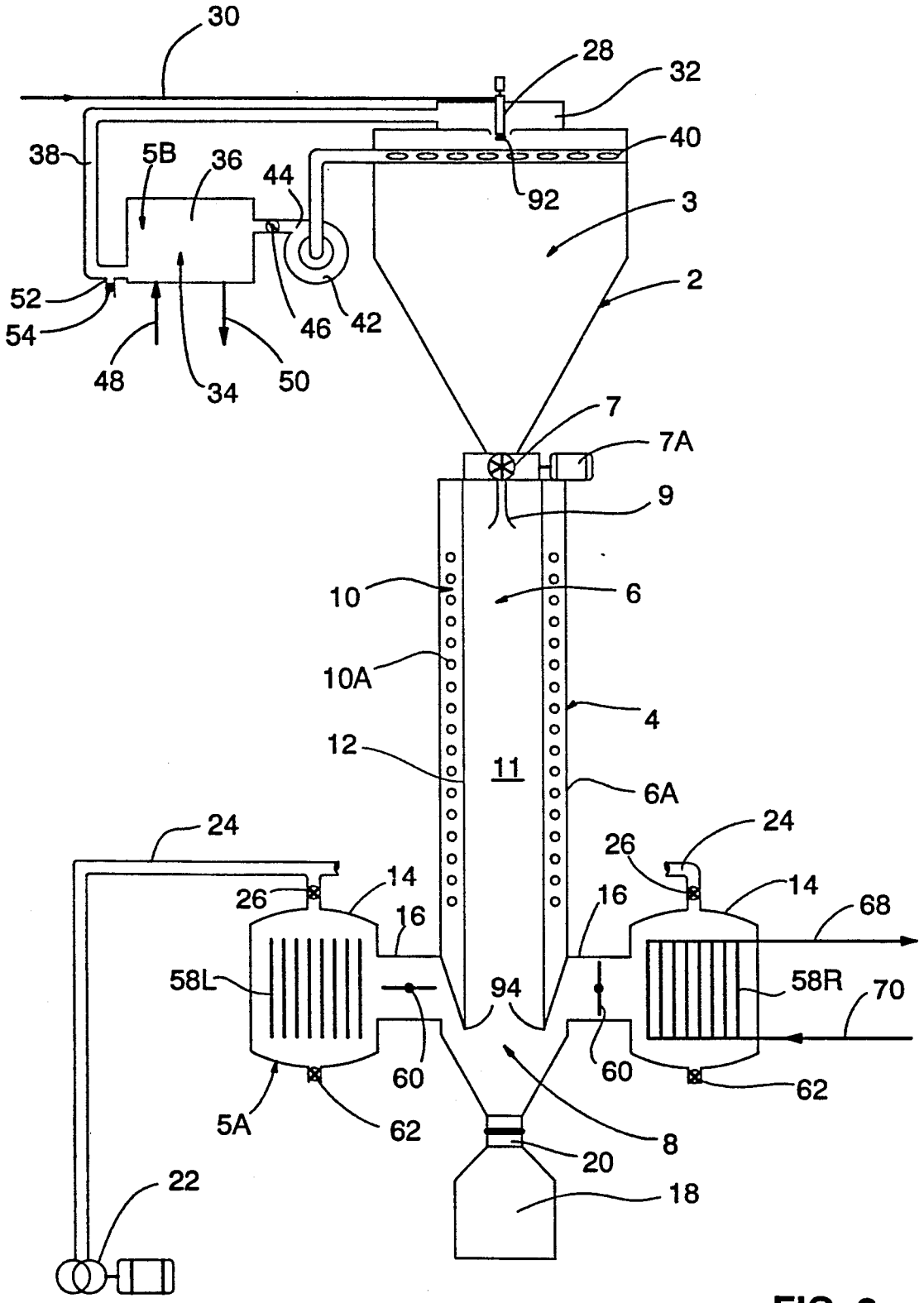
FIG. 2 shows the same view as FIG. 1, but without the supporting structure.

Referring in detail to FIGS. 1 and 2, they show a first embodiment of a flash-sublimation system 2 of the invention comprising a freezer section 3, drier section 4, vapor condenser section 5A and heat exchanger section 5B. Frozen particles (not shown) formed in the freezer section 3 are metered downward into section 4 by rotary valve 7 operated by motor 7A, which also serves to isolate the ambient pressure in the freezer section 3 from the vacuum in the section 4.

The drier section 4 comprises a drier top section 6 and drier bottom section 8. Section 4 is connected to freezer section 3 via a flared conduit 9.

Top section 6 is equipped with heating means 10, including heating unit 10A, separated from the interior 11 of the drier section 4 by internal shielding 12. In one preferred embodiment, heating unit 10A may comprise electric heating elements to supply heat electrically. In another embodiment, steam can be circulated in a jacket (not shown) surrounding the drier section 6. Other equivalent heating arrangements may comprise heating means 10.

Condenser section 5A comprises vapor condensers 14 that are connected to bottom section 8 by ducts 16, one on each side. A product canister 18 to receive dehydrated product (not shown) is joined to section 8 by coupling 20 which permits the canister 18 to be removed for transport to packaging equipment (not shown).

Vacuum is maintained in system 2 below valve 7 by vacuum pump 22 plus associated piping 24 and valves 26 that comprise components of the condenser section 5A.

Vacuum pump 22 operates continuously to remove any non-condensable gases which are not removed by the vapor condensers 14. The volume of such gases will be quite small except during initial evacuation of the system at startup, so the vacuum pump 22 and associated pipes 24 can be modest in size.

Liquid material (not shown) to be processed in system 2 is sprayed into freezer section 3 through nozzle assembly 28, fed from product storage tanks (not shown) by feed supply line 30. Cold air is circulated around nozzle assembly 28 via plenum 32 supplied from cooling means 34 of heat exchanger section 5B. The nozzle assembly 28 may be designed in a number of ways, all known to those skilled in the art. Examples include a single-fluid pressure nozzle, a two fluid (compressed air) nozzle, or a rotating nozzle. Each have specific advantages and disadvantages.

The nozzle assembly 28 shown in FIGS. 1 and 2 is a rotating atomizer nozzle. This design is essentially self-feeding, so the product feed system is quite simple. The size of the droplets formed at the nozzle can be controlled by parameters such as the speed of rotation, product viscosity, feed rate, and the design of the spinning nozzle wheel. Generally, the spinning wheel will rotate at about 10,000 RPM or faster.

In means 5B, air is cooled in heat exchanger 36, supplied to plenum 32 via line 38 and returned to exchanger 36 via gas return duct 40, blower 42 and inlet 44 controlled by valve 46.

Heat exchanger 36 is supplied with cold refrigerant from a refrigeration system (not shown) via inlet line 48 and return line 50.

Condensate may be removed from the heat exchanger 36 through outlet 52 under control of valve 54.

All equipment is constructed of stainless steel or equivalent corrosion resistant metal for cleanliness and ease of maintenance. Both freezer section 3 and drier section 4, with their associated attachments, are thermally insulated with suitable insulation (not shown). Freezer section 3 is approximately 2 meters in maximum diameter and 2½ meters high. The drying tower 6A is approximately 5 meters high and about 1 meter or more in diameter. The heating unit 10A of the heating means 10 typically is about 3 meters high.

Figure 3:
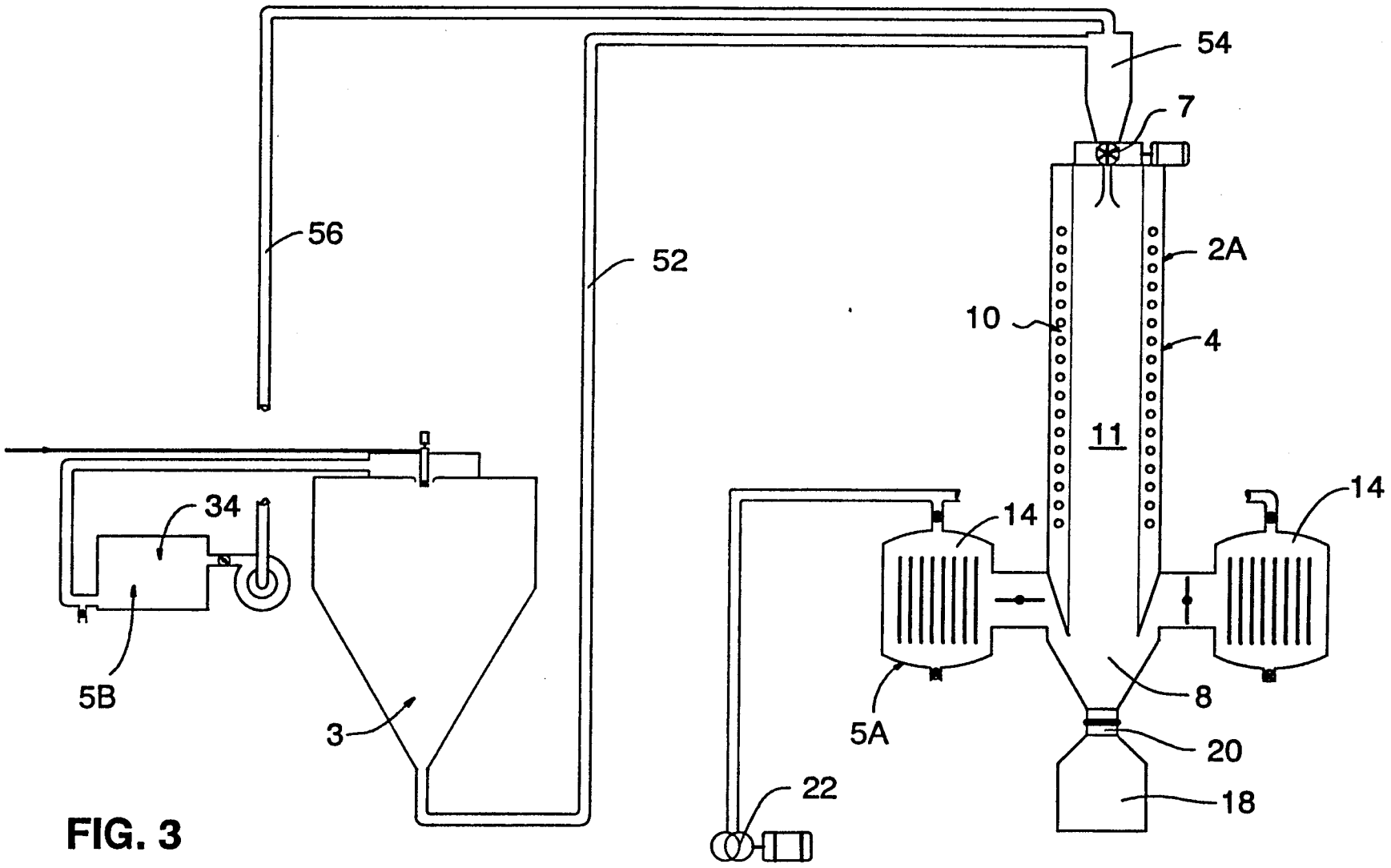
FIG. 3 is a diagrammatic elevational view of a second embodiment in which the freezer vessel is horizontal to the drying tower rather than vertically arranged.

As mentioned earlier, the height of the complete system is over about 10 meters. To fit into facilities with lower roofs, FIG. 3 shows a second embodiment of a system 2A of the invention in which the freezer section 3 is placed to the side of the drier section 4 rather than on top of it. Conduit 52 then carries frozen particles (not shown) to cyclone separator 54 and air returns therefrom to heat exchanger section 5B via return pipe 56.

Figure 4:
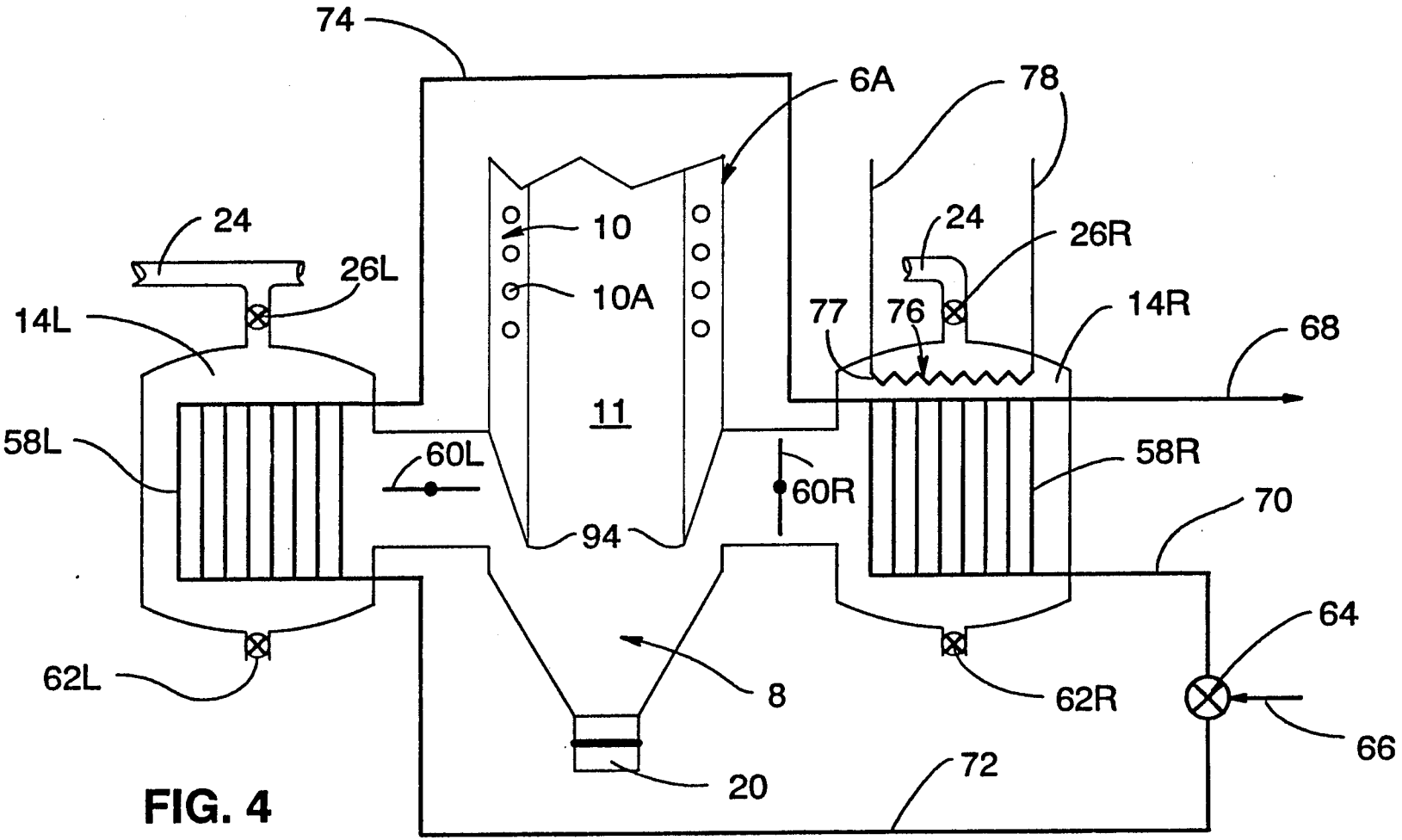
FIG. 4 is a diagrammatic fragmentary elevational view showing details of incorporation of ice condensers into the rest of the freeze drying system of the invention.

FIG. 4 shows a detailed view of the condenser section 5A. In addition to previously mentioned lines 24 and valves 26, section 5A comprises condenser plates 58L and 58R, condenser access valves 60L and 60R, liquid removal valves 62L and 62R, 3-way valve 64, refrigerant supply line 66, refrigerant return line 68, condenser plate inlet lines 70 and 72 and condenser plate interconnect line 74.

Section 5A may advantageously include a heater means 76 including electric heater unit 77 and power supply lines 78 to supply heat to defrost the section 5A. Alternatively, heater means 76 can comprise a spray nozzle (not shown) above the condenser plates 58L and 58R to inject hot water or steam over such plates.

Figure 6:
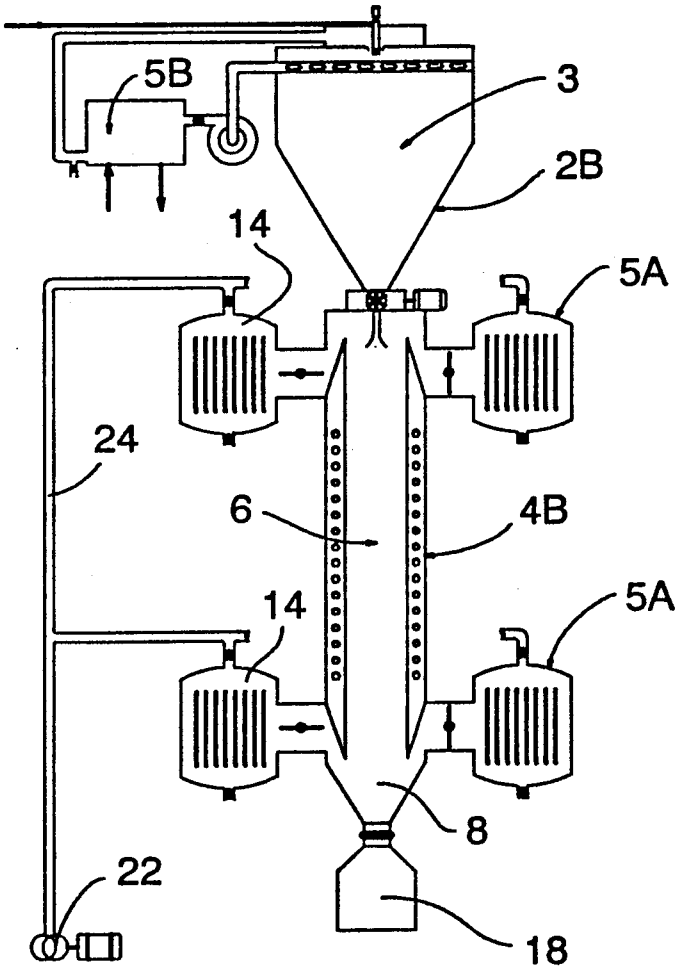
FIGS. 5 and 6 are diagrammatic elevational views of third and fourth embodiments in which ice condensers are located at the middle and at both the top and bottom, respectively.
Figure 5:
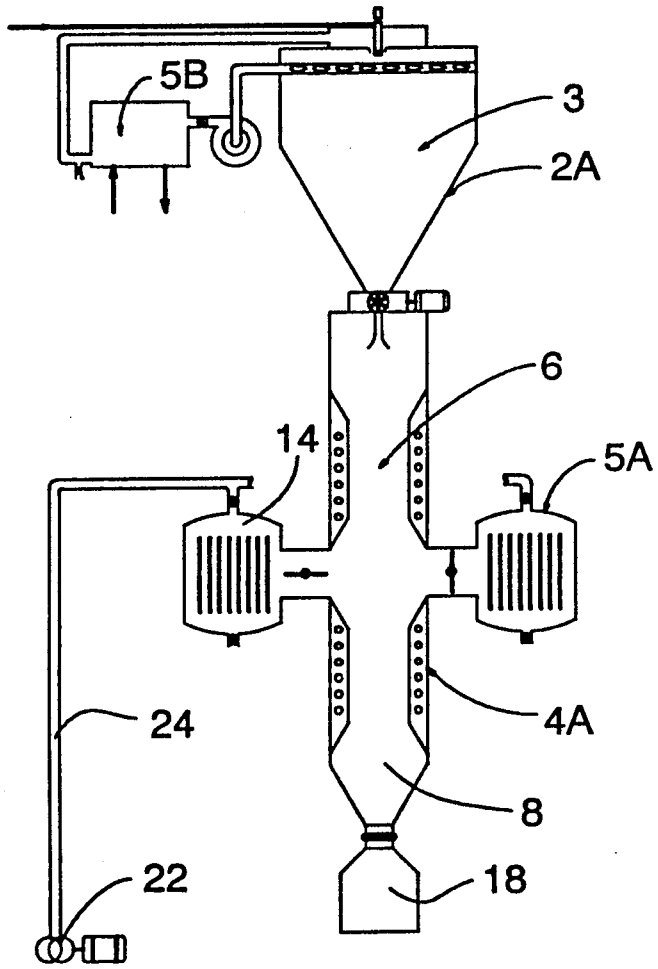

FIGS. 5 and 6 show alternate embodiments in which the condenser sections 5A are relocated relative to the drier section 4. In FIG. 5 the condenser section 5A located at the middle of the drier section 4A. In FIG. 6 two condenser sections 5A are located at the top and bottom of the drier section 4B. These alternate placements provide variations in the vapor path and the effect of vapor movement on the transit of the particles through the systems 2A and 2B.

Figure 7:
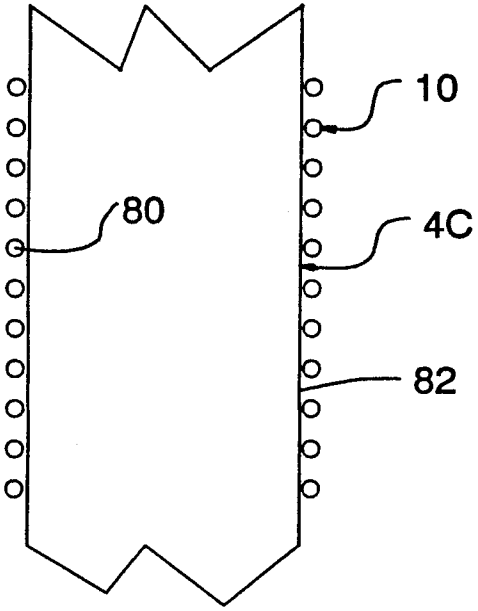
FIG. 7 is a fragmentary lateral view of an alternate embodiment of the heat source for a freeze drying system of the invention.

FIG. 7 shows an alternate embodiment of the heating means 10 comprising a series of electrically-powered resistance elements 80, circular as shown or vertical strips (not shown), mounted on the outside of wall 82 of the drier section 4C. Another embodiment (not shown) for the heating means 10 comprises a jacket containing steam channels which can be fed with high-temperature steam. Neither the electrical power supply nor the steam generator are shown. In both cases, the source of power is adjustable to precisely control the temperature of the heating means 10.

Figure 8:
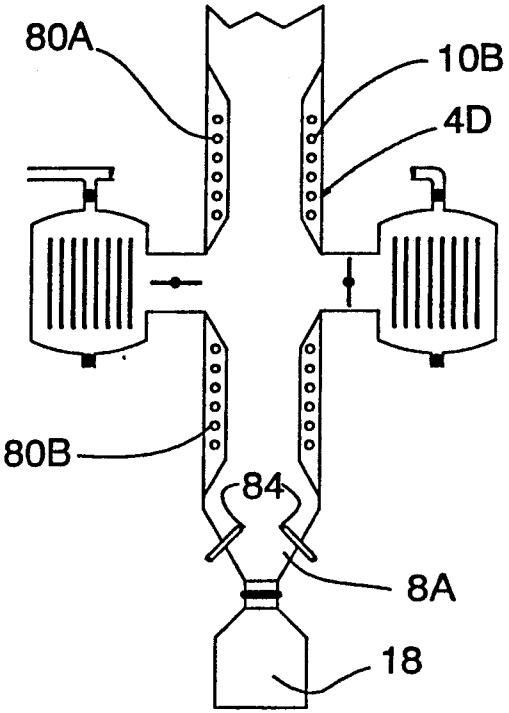
FIG. 8 is a fragmentary lateral view of another alternate embodiment of a freeze drying system of the invention.

FIG. 8 concerns an embodiment in which the heating means 10B is divided into a plurality of heating elements 80A and 80B configured to provide two or more separately controllable zones along the height of the drier section 4D. A similar effect can be attained in the embodiment shown in FIG. 5 by having the portion of heating elements in the upper part of drier section 4A separately controlled from the portion of heating elements in the lower part of the drier section 4A.

A further feature of the embodiment of FIG. 8 is the provision of gas inlets 84 in the bottom section 8A through which auxiliary dry gas can be introduced to modify the speed of movement and drying of particles passing downward in the drier section 4D.

Figure 9:
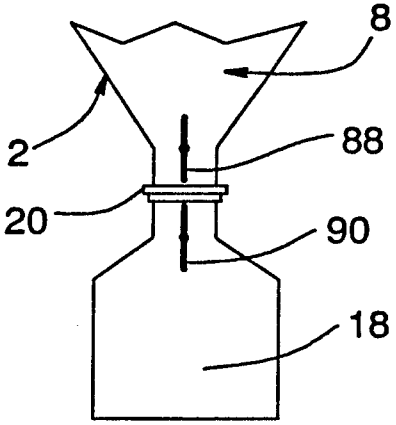
FIG. 9 is a fragmentary lateral view of a canister attachment for the new freeze drying systems and related valves.

FIG. 9 shows detail of the canister 18 and airtight mating collar 20 by which it is attached to the bottom of the heater bottom section 8. Valves 88 and 90 serve to isolate canister 18 from the remainder of system 2 to prevent loss of internal vacuum. Canister 18 is large enough to accommodate approximately one hour of production, which may be as high as 50 kg per hour of dried solids, depending on the starting concentration of the feed material.

From the above description of the new systems of the invention, it will be apparent that they are characterized by the provision of a freezer section in which frozen particles of liquid product are formed at ambient pressure followed by a drier section in which such particles are subjected to radiant heat in a vacuum to remove liquid therefrom by sublimation from which the resulting dried particles can be discharged into a receptacle. Such systems further essentially comprise vapor condenser means to dispose of liquid vapors generated by the sublimation.

These new freeze-drying systems enable new freeze drying methods that essentially comprise (a) dispersing fine particles of fluid material containing liquid and solid components into a confined zone, (b) providing gas maintained substantially at ambient pressure and a temperature appreciably below the freezing point of the liquid component of such material to produce frozen particles, (c) transferring the frozen particles to a vacuumized, vertically elongated zone, (d) allowing the frozen particles to fall through such elongated zone while subjecting them to radiant heat sufficient to sublime therefrom substantially all of their liquid component thereby producing substantially liquid component free particles and (e) removing such particles from the elongated zone.

In carrying out new methods of freeze-drying in accordance with the invention, liquid product to be treated is pumped from liquid holding tanks (not shown) via the feed line 30 to the nozzle assembly 28. Cold air flows from plenum 32 in a stream coaxially surrounding the nozzle assembly 28. The cold gas mixes intimately with the droplets flying off the spinning nozzle wheel 92, freezing them almost instantly. The gas flow, by way of example, is approximately 500 cubic meters per hour, at an entry temperature of −60° C. The frozen particles then settle to the bottom of the freezer section 2, where they are fed by rotary valve 7 into the drier section 4.

The drier section 4 is evacuated to a vacuum by pump 22 and pipes 24 under the control of associated valves 26 and 60. The frozen particles fall freely downward in interior 11, accelerated by gravity and by the flow of vapor. The top portion 6 of the drier section 4 is heated by heating means 10 separated from the particles by shield 12. The heat absorbed by the particles causes sublimation of ice or other equivalent frozen liquid component, resulting in complete drying during the flight time through the heater top section 6. Resulting dried particles then settle into the bottom section 8, where they can then be transferred into canister 18.

The vapor formed during drying is removed by condenser section 5A. Since the section 5A, particularly plates 58L and 58R, is colder than the vapor, the resulting pressure differential will move the vapor out of the drier section 4 and into the condenser section 5A. The flow will be downward at first, around the end of the baffle 94 formed by the bottom tip of the internal shield 12, past the valves 60 and into the condensers 14. The vapor will then condense and freeze as snow or ice on the plates 58L and 58R, supplied with refrigerant via lines 68 and 70 connected to the refrigeration system (not shown). The reversal of direction of the vapor flow as it passes around the tip of the baffle 94 helps separate the particles from the vapor stream, since the particles, being heavier, will not reverse direction and will continue downward.

Periodically vapor condensers 14 must be defrosted to remove the ice frozen on plates 58L and 58R and for this purpose the condensers 14 are placed in alternate service, i.e., one side, e.g., the left side containing plates 58L are in service with related valve 60 open as shown in FIG. 2, while the right side with plates 58R are being defrosted.

With reference to FIG. 4, when defrosting is required, valve 60R on the formerly closed condenser 14R is opened, and the valve 60L on left side with the ice-loaded plates 58L is closed. Valve 26R on the now active side is also opened, while valve 26L on the loaded condenser 14L is closed. These actions isolate the loaded condenser 14L from both the drier section 4 and the vacuum pump 22. As condenser 14L defrosts, melt water (not shown) will collect in the bottom of the condenser 14L, where it can be removed via melt water removal valve 62. The two condensers 14L and 14R are toggled back and forth so that one is always active while the other is defrosting, allowing continuous operation of the rest of the system 2.

In the toggling operation between condensers 14L and 14R as described, the source of refrigeration to plates 58L & 58R must also be toggled. This is accomplished by 3-way valve 64, which switches the refrigerant supply line 66 between the two condensers. Refrigerant returns via line 68, while lines 72 and 74 serve to interconnect condensers 14L and 14R.

I claim:

1. A system for the deliquification of liquid-containing substances by freeze-drying comprising:

a freezer section, a drier section, a vapor condenser section and a heat exchange section, said freezer section including:

an enclosed chamber partially defined by an upper inlet and a lower outlet, means to introduce cooled process gas into said chamber, nozzle means positioned in said inlet to spray said liquid-containing substance into said chamber to contact said cooled process gas and form frozen particles thereof within said chamber, and exhaust means to remove said process gas from said chamber;

said drier section including:

a vertically elongated top sector having an upper entrance, a lower exit, a tubular interior defined by an internal wall joining said entrance with said exit, heating means surrounding said wall to supply radiant heat to said tubular interior, and a bottom sector partially defined by an open upper end and a conical lower portion depending from said upper end terminating in a discharge outlet;

said lower outlet of said chamber being connected to said upper entrance of said top sector by means to discharge said frozen particles from said chamber into said drier section to fall through said tubular interior of said top sector while vapor is sublimed from said frozen particles by said supplied heat, said vapor condenser section including:

condenser means comprising:

a first enclosure, first cooling means positioned in said first enclosure, and duct means communicating said first enclosure with said drier section for flow of said vapor therefrom into said enclosure, and vacuum means to create a vacuum in said first enclosure and said drier section;

said heat exchange section including:

a second enclosure having a fluid outlet and a fluid inlet, second cooling means positioned in said second enclosure to cool process gas present therein, first conduit means connecting said fluid outlet to said plenum means for flow of cooled process gas from said second enclosure into said freezer section via said plenum means, and second conduit means connecting said exhaust means to said fluid inlet for flow of said process gas from said freezer section to said second enclosure.

2. The system of claim 1 wherein said second conduit means comprises pump means to cause said flow of said process gas.

3. The system of claim 1 designed for the dehydration of water-containing substances to produce dried substance particles.

4. The system of claim 3 designed for the dehydration of food and biological substances to produce dried particles thereof.

5. The system of claim 1 wherein said exhaust means comprises a tubular manifold positioned within said chamber adjacent said upper inlet.

6. The system of claim 1 wherein said exhaust means comprises a cyclone separator.

7. The system of claim 1 that comprises a plurality of said condenser means.

8. The system of claim 7 wherein said duct means of said condenser means communicate said first enclosures thereof with said bottom sector.

9. The system of claim 7 wherein said plurality of said condenser means are divided into upper and lower divisions and said duct means of said upper division communicate said first enclosures thereof with said upper entrance of said top sector of said drier section and said duct means of said lower division communicate said first enclosures thereof with said bottom sector.

10. The system of claim 1 wherein said duct means communicates said first enclosure with said drier section at a location in said drier section between said upper entrance and said lower exit.

11. The system of claim 1 wherein heating means comprises at least two separate heating elements capable of independent control of their radiant energy output.

12. The system of claim 1 wherein said bottom sector includes means to introduce auxiliary gas into said drier section.

13. A system for the deliquification of liquid-containing substances by freeze-drying comprising:

a freezer section, a drier section, a vapor condenser section and a heat exchange section, said freezer section including:

an enclosed chamber partially defined by a vertical axis, an upper inlet and a lower outlet, said inlet and said outlet being concentric with said axis, plenum means to introduce cooled process gas into said chamber, nozzle means positioned in said inlet to spray said liquid-containing substances into said chamber to contact said cooled process gas and form frozen particles thereof within said chamber, and exhaust means to remove said process gas from said chamber;

said drier section including:

a vertically elongated top sector having an upper entrance, a lower exit, a tubular interior defined by an internal wall joining said entrance with said exit, heating means surrounding said wall to supply heat to said tubular interior, and a bottom sector partially defined by an open upper end and a conical lower portion depending from said upper end terminating in a discharge outlet;

said lower outlet of said chamber being connected to said upper entrance of said top sector by meter means to discharge said frozen particles from said chamber through said lower outlet into said drier section to fall through said tubular interior of said top sector while vapor is sublimed from said frozen particles by said supplied heat, said vapor condenser section including:

condenser means comprising:

a first enclosure, first cooling means positioned in said enclosure, duct means communicating said enclosure with said bottom sector for flow of said vapor from said bottom sector into said enclosure, and vacuum means to create a vacuum in said first enclosure and said drier section;

said heat exchange section including:

a second enclosure having a fluid outlet and a fluid inlet, second cooling means positioned in said second enclosure to cool process gas present therein, first conduit means connecting said fluid outlet to said plenum means for flow of cooled process gas from said second enclosure into said chamber via said plenum means, second conduit means connecting said exhaust means to said fluid inlet for flow of said process gas from said chamber to said second enclosure.

14. The system of claim 13 wherein said second conduit means comprises pump means to cause said flow of said process gas.

15. The system of claim 13 designed for the dehydration of water-containing substances to produce dried substance particles.

16. The system of claim 15 desinged for the dehydration of food and biological substances to produce dried particles thereof.

17. The system of claim 13 wherein said duct means communicates said first enclosure with said drier section at a location in said drier section between said upper entrance and said lower exit.

18. A freeze-drying method for the deliquification of a solid substance associated with liquid in the form of a liquid product to produce solid particles of said substance substantially devoid of said liquid which comprises:

providing an enclosed freezer zone defined by an upper inlet and a lower outlet, maintaining said freezer zone approximately at ambient pressure, spraying a stream of said liquid product into said freezer zone to form liquid spray particles thereof that fall freely within said freezer zone, circulating cool process gas through said freezer zone from a source external of said freezer zone to contact said falling spray particles and turn them into frozen particles of said liquid product containing frozen liquid, providing a drier zone separate from said freezer zone comprising an upper entrance, a lower exit and a vertically elongated enclosed region joining said entrance with said exit, maintaining said drier zone under a vacuum, transferring said frozen particles from said freezer zone to said drier zone without substantial loss of vacuum from said drier zone into said freezer zone, allowing said frozen particles to fall freely through said enclosed region, supplying heat to said enclosed region from a heat source external of said enclosed region sufficient to sublime said frozen liquid of said falling frozen particles into vapor, providing a condenser zone containing a condensation surface therein separate from said freezer and drier zones, applying a vacuum to said condenser zone substantially equal to said vacuum of said drier zone, communicating said drier zone with said condenser zone to permit transfer of said vapor from said drier zone into said condenser zone, cooling said condensation surface to a temperature substantially below the freezing point of said vapor, allowing vapor in said condenser zone to freeze on said condensation surface, allowing vapor from said drier zone to move without forced circulation into said condenser zone to replace vapor condensed in said condenser zone on said condensation surface, and discharging particles of said solid substance from said drier zone.

19. The method of claim 18 wherein first and second condenser zones are provided and they are operated alternatively in a first stage to condense vapor from said drier zone and in a second stage to remove frozen vapor from said condensation surface.

20. A freeze-drying method for the deliquification of fluid material consisting essentially of a freezable liquid component and a solid component to produce solid particles of said solid component substantially devoid of said liquid component which comprises:

spraying fine particles of said fluid material into a confined zone, circulating in said confined zone gas maintained substantially at ambient pressure and a temperature appreciably below the freezing point of said liquid component to produce frozen particles of said fluid material, transferring said frozen particles to a vacuumized, vertically elongated zone separate from said confined zone, allowing said frozen particles to fall substantially independently through said elongated zone subjecting said falling particles to radiant heat throughout said fall through said elongated zone to sublime therefrom substantially all of their said liquid component thereby producing substantially liquid component free particles and removing said liquid component free particles from said elongated zone.

21. The freeze-drying method of claim 20 for the dehydration of fluid material consisting essentially of water and a solid component to produce dehydrated solid particles of said solid component which comprises:

spraying fine particles of said fluid material into a confined zone, circulating in said confined zone gas maintained substantially at ambient pressure and a temperature appreciably below 0° C. to produce frozen particles of said fluid material, transferring said frozen particles to a vacuumized, vertically elongated zone separate from said confined zone, allowing said frozen particles to fall substantially independently through said elongated zone subjecting said falling particles to radiant heat throughout said fall through said elongated zone to sublime therefrom substantially all of their water content thereby producing substantially dehydrated particles and removing said dehydrated particles from said elongated zone.

* * * * *